US010309133B2

(12) United States Patent
Han et al.

(10) Patent No.: US 10,309,133 B2
(45) Date of Patent: Jun. 4, 2019

(54) RETRACTABLE OUTSIDE DOOR HANDLE ASSEMBLY FOR VEHICLE

(71) Applicants: HYUNDAI MOTOR COMPANY, Seoul (KR); SEUNGWON IND. CO., LTD, Pyeongtaek-si (KR)

(72) Inventors: Jungho Han, Seoul (KR); Sang Kil Park, Seoul (KR)

(73) Assignees: HYUNDAI MOTOR COMPANY, Seoul (KR); SEUNGWON IND. CO., LTD, Pyeongtaek-si (KR)

( * ) Notice: Subject to any disclaimer, the term of this patent is extended or adjusted under 35 U.S.C. 154(b) by 322 days.

(21) Appl. No.: 15/371,400

(22) Filed: Dec. 7, 2016

(65) Prior Publication Data

US 2018/0058113 A1 Mar. 1, 2018

(30) Foreign Application Priority Data

Aug. 24, 2016 (KR) ..... 10-2016-0107731

(51) Int. Cl.
*E05B 85/10* (2014.01)
*E05B 79/20* (2014.01)
(Continued)

(52) U.S. Cl.
CPC ..... *E05B 85/107* (2013.01); *E05B 79/20* (2013.01); *E05B 85/06* (2013.01); *E05B 85/103* (2013.01); *E05B 85/16* (2013.01)

(58) Field of Classification Search
CPC ..... Y10S 292/31; Y10S 292/30; E05B 85/10; E05B 85/103; E05B 85/107; E05B 85/06; E05B 85/16; E05B 79/20; Y10T 16/451; Y10T 16/44; Y10T 16/4554; Y10T 16/473; Y10T 292/57
(Continued)

(56) References Cited

U.S. PATENT DOCUMENTS

2004/0113434 A1 6/2004 Lane
2013/0127185 A1* 5/2013 Lang ..... E05B 85/103 292/336.3
(Continued)

FOREIGN PATENT DOCUMENTS

DE 102015209852 A1 * 12/2016 ..... E05B 85/103
JP 08-326366 12/1996
(Continued)

*Primary Examiner* — Alyson M Merlino
(74) *Attorney, Agent, or Firm* — McDonnell Boehnen Hulbert & Berghoff LLP

(57) ABSTRACT

Disclosed is a retractable door handle assembly for a vehicle. The assembly includes: a retractable door handle installed in a door of the vehicle to be projected or retracted further to the outside in a width direction of the vehicle than a outer door panel constituting the door; and a linkage connected to the door handle to support the door handle so that the door handle pops out to the outside in the width direction of the vehicle and pops in to the inside in the width direction of the vehicle. The linkage includes a main link having one end connected to the door handle, and an auxiliary link having one end connected to the main link to support a pivot movement of the main link, and as a result, pop-out and pop-in operations of the door handle can be stably performed.

17 Claims, 15 Drawing Sheets

(51) Int. Cl.
*E05B 85/06* (2014.01)
*E05B 85/16* (2014.01)

(58) Field of Classification Search
USPC ..... 49/460, 503
See application file for complete search history.

(56) References Cited

U.S. PATENT DOCUMENTS

| | | | | |
|---|---|---|---|---|
| 2015/0315826 | A1* | 11/2015 | Lang | E05B 85/103 49/503 |
| 2016/0281397 | A1* | 9/2016 | Park | E05B 85/107 |

FOREIGN PATENT DOCUMENTS

| | | | | |
|---|---|---|---|---|
| KR | 2005-0100215 | A | 4/2006 | |
| KR | 10-20130131311 | | 3/2013 | |
| KR | 10-1637820 | | 7/2016 | |
| WO | 2016-188694 | A1 | 1/2016 | |
| WO | WO-2016113341 | A1 * | 7/2016 | E05B 85/103 |

* cited by examiner

RETRACTABLE OUTSIDE DOOR HANDLE ASSEMBLY FOR VEHICLE

CROSS-REFERENCE TO RELATED APPLICATION

This application claims priority to and the benefit of Korean Patent Application No. 10-2016-0107731 filed in the Korean Intellectual Property Office on Aug. 24, 2016, the entire contents of which are incorporated herein by reference.

BACKGROUND (a) Technical Field

The present disclosure relates to a retractable door handle assembly for a vehicle, and more particularly, to a retractable door handle assembly for a vehicle in which a door handle, in one state, can be retracted into an outer panel of the door, and in another state, can be projected outward from the outer panel of the door.

(b) Description of the Related Art

In general, a vehicle can have an interior of a predetermined size, in which a driver and perhaps additionally one or more accompanying passengers can ride. Accessible in the interior of the vehicle may be a mechanism for opening and closing a door of the vehicle. There may also be a similar mechanism accessible on the outside of the vehicle.

For example, there may be one door handle mounted on an inner surface of the door towards the interior of the vehicle and there may be another door handle mounted on an outer surface of the door toward the outside of the vehicle.

Each door handle is connected to a door latch that fixes the door to a vehicle body, and as a result, the door can be opened when the door latch is released by operating either door handle.

The outer door handle is normally pivotably mounted on an outer panel of the door (which may be referred to hereafter as the "outer door panel") and is installed in the outer door panel and projected laterally outward from the vehicle (i.e., projected along a lateral axis or a "width direction" of the vehicle) so that the passenger can easily grip the door handle.

When the door handle is installed to project laterally outward from the vehicle, operating convenience for the passenger is improved, but the external appearance of the vehicle can deteriorate due to the projection of the door handle (i.e. the door handle is not flush with the door). In addition, driving noise can be exacerbated while the vehicle is driven and driving performance can also deteriorate due to additional resistance caused by the protrusion of the door handle.

In recent years, in order to solve this problem, a retractable door handle has been developed, in which a motor causes the door handle to be either projected laterally outward from the outer door panel or retracted into an recess formed in the outer door panel.

A fail-safe function may be desired that can improve stability of the retractable door handle or allow for a key to be used to operate the door handle in a scenario where the motor fails or is otherwise unable to project or retract the door handle.

The above information disclosed in this Background section is only for enhancement of understanding of the background of the present disclosure and therefore it may contain information that does not form the prior art that is already known in this country to a person of ordinary skill in the art.

SUMMARY

The present disclosure provides a retractable door handle assembly for a vehicle, where, in one state, the retractable handle is retracted into an outer door panel as necessary to improve an external appearance of the vehicle, and, in another state, the retractable handle is projected laterally outward from the outer door panel to allow a passenger to more easily operate the retractable handle.

An example embodiment of the present disclosure provides a retractable door handle assembly for a vehicle, including: a retractable door handle installed in a door of the vehicle, the retractable door handle being configured to project laterally outward from or retract into an outer door panel; and a linkage connected to the door handle to support the door handle so that the door handle pops out from the outer panel and pops into the outer panel, where the linkage includes a main link having one end connected to the door handle, and an auxiliary link having one end connected to the main link to support pivoting of the main link.

The main link may include a first main link having one end connected to the door handle and further include a second main link having one end connected to the door handle. The auxiliary link may include a first auxiliary link having one end connected to the first main link to support a pivot movement of the first main link and further include a second auxiliary link having one end connected to the second main link to support a pivot movement of the second main link. The first main link and the first auxiliary link may form a first pair disposed toward a front end of the vehicle. The second main link and the second auxiliary link may form a second pair disposed toward a rear end of the vehicle.

The retractable door handle assembly may further include a base plate, a first elongated guide hole formed in the base plate towards a front end of the vehicle and a second elongated guide hole formed in the base plate toward a rear end of the vehicle. A first link pin is joined to the first main link and a second link pin is joined to the second main link, and the first and second link pins are inserted into and move along the first and second elongated guide holes, respectively. The first elongated guide hole may be shorter than the second elongated guide hole.

The base plate may include an outer surface facing the outside of the vehicle in the width direction of the vehicle, an upper surface extending towards a vehicle interior from an upper edge of the outer surface, and a lower surface extending towards the vehicle interior from a lower edge of the outer surface, and the first and second elongated guide holes may be formed on the upper surface and the lower surface, respectively.

The door handle may include a graspable handle body that can be grasped/gripped by a passenger, and may also include an insertion hole formed in the handle body, into which the passenger can insert a hand.

An inner cover plate may be joined to the base plate facing the vehicle interior, and a boss may be formed on the inner cover plate so that a pin can be inserted into the boss and the auxiliary link can be mounted such that the auxiliary link is pivotable around the pin.

The retractable door handle assembly may further include a cover mechanism connected with the linkage and guiding the handle when the passenger inserts the hand into the insertion hole by covering one surface of the insertion hole.

The cover mechanism may include an auxiliary cover guiding a passenger's hand when the passenger inserts a hand into the insertion hole by covering one surface of the insertion hole and a cover link having one end joined to the main link with the pin and the other end joined to the base plate in order to link the auxiliary cover with the door handle.

The retractable door handle assembly may further include a driving device providing operation force to the linkage, and the driving device may include a driving motor generating rotational force, and a cam allowing the first and second links to move along the first and second elongated guide holes by transferring the rotational force of the driving motor to the first and second link pins of the main link.

There may be a single cam or a pair of cams connected to be integrally rotatable by a rotational shaft. The rotational shaft may be connected to the driving motor so as to receive rotational force from the driving motor.

The cams may have an "S" shape and include two cam grooves having a "U" shape to engage and move the first and second link pins, respectively and two cam push surfaces having an arc shape to push and move the first and second link pins.

A torsion spring which elastically supports the auxiliary link may be installed in a region where the auxiliary link is joined with the pin.

A stopper protrusion may be formed on the base plate and a stopper projection may be formed at one end of the cam to block rotational movement of the cam by contacting the stopper protrusion.

The retractable door handle assembly may further include a door latch cable connected with a door latch that unlocks the door latch when pulled; and a door latch link rotatably installed and connected with the door latch cable. The door latch link may have an operation groove into which the second link pin is selectively inserted allowing the door latch link to rotate.

The retractable door handle assembly may further include: a key cylinder for inserting a key of the vehicle and rotatably operating the key; a first door latch release rod having one end connected to the key cylinder and another end connected to the pin; and a second door latch release rod having one end connected to the pin and another end connected to the door latch cam.

A guide groove which guides and moves the first door latch release rod may be formed on the inner cover plate.

The retractable door handle assembly may further include a control lever rotatably installed and capable of moving the first and second link pins.

A lower cover plate having a guide hole may be formed at one edge may be joined to a lower side of the base plate. The control lever may be rotatably installed on the lower cover plate, and a fixing screw may be joined to one end of the control lever. The fixing screw may be inserted into the guide hole so as to be guided and moved along the guide hole.

First and second cam surfaces contacting the first and second link pins may be formed in the control lever.

According to an example embodiment, in a retractable door handle assembly for a vehicle, when a door need not be opened, an door handle is retracted into an outer door panel to improve the external appearance of the vehicle and reduce driving noise and driving resistance caused by projection of the door handle laterally from the outer door panel, resulting in improved marketability of the vehicle.

The improved retractable door handle disclosed herein has a simple structure, and therefore provides reduced vehicle weight and cost, in addition to improving the ride quality and overall appearance of the vehicle.

When the door handle cannot be projected laterally (i.e popped out) due to a failure of the driving motor, a door latch can be released by use of a vehicle key, and as a result, the disclosure further provides a fail-safe, again improving marketability of the vehicle.

Because the height of projection of a skin surface of the door handle can be manually controlled through a skin surface control device of the door handle, assembly productivity can be improved by absorbing manufacturing tolerance and assembly tolerance.

The door handle is projected or retracted through a linkage, and as a result, the door handle can be stably projected and retracted.

Also provided in the disclosure is a cover for guiding a passenger's hand when a passenger operates the door handle by inserting his/her hand into an insertion hole formed in the door handle in order to operate the outward-projected door handle, resulting in improved operating convenience.

DETAILED DESCRIPTION OF THE EMBODIMENTS

Hereinafter, an example embodiment of the present disclosure is described in detail with reference to the accompanying drawings.

Figure 1:
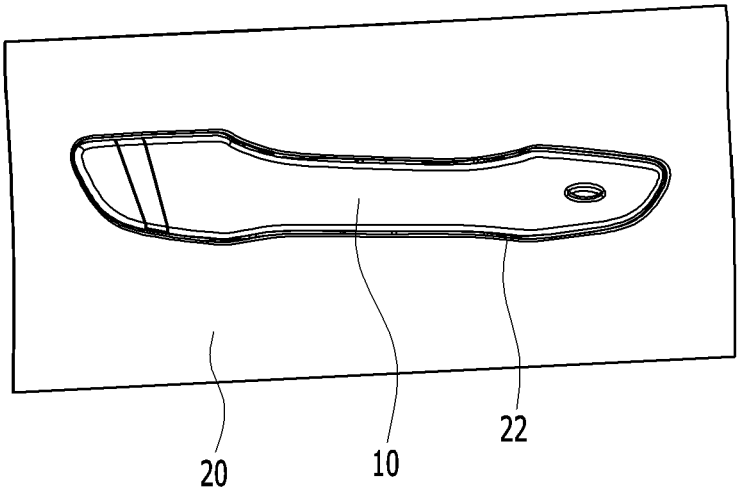
FIG. 1 is a plan view of a retractable door handle assembly mounted on a outer door panel according to an example embodiment.

FIG. 1 illustrates a portion of a vehicle door, and in particular, a portion of an outer door panel 20 of a vehicle door. Outer door panel 20 includes a recess 22 for accommodating a retractable door handle 10, which is mounted on outer door panel 20.

Recess 22 has a profile corresponding to the shape of door handle 10, and as a result, door handle 10 may be retracted into recess 22 or projected outward from recess 22 in the width direction of the vehicle.

Figure 2:
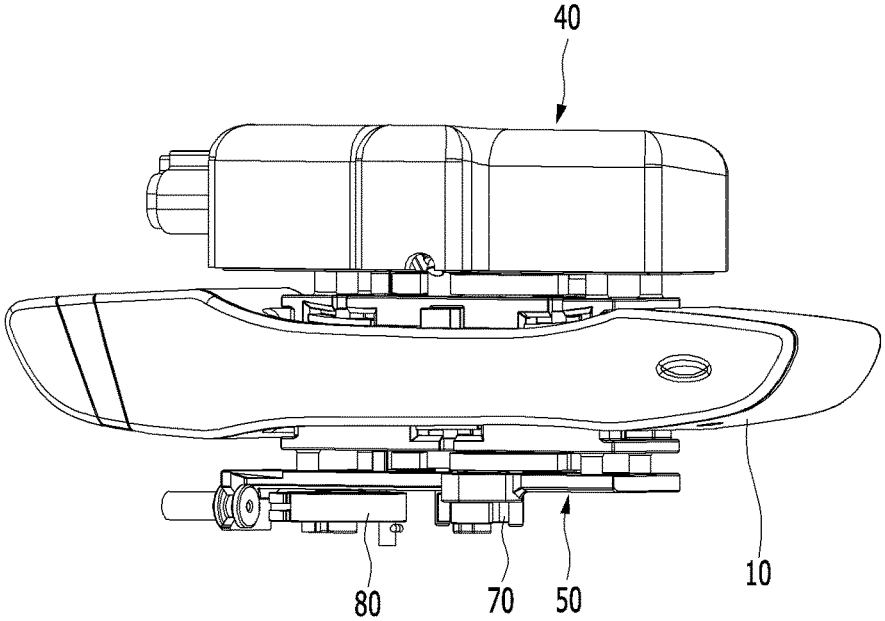
FIG. 2 is a perspective view of a retractable door handle assembly according to an example embodiment.
Figure 3:
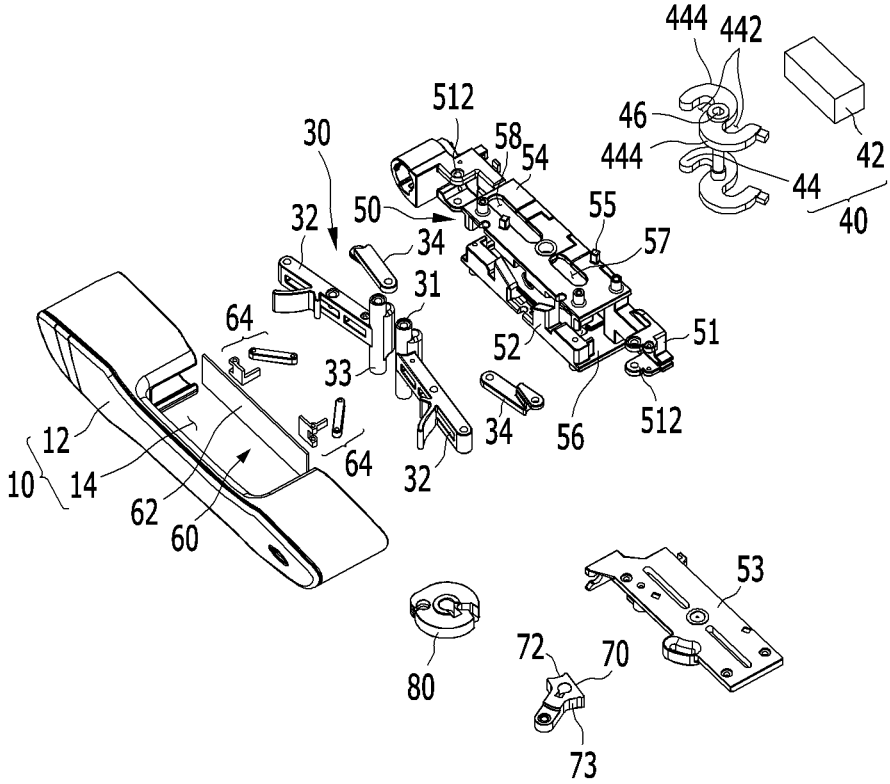
FIG. 3 is an exploded perspective view of a retractable door handle assembly according to an example embodiment.

Referring to FIGS. 2 and 3, an example embodiment of the retractable door handle assembly for the vehicle may include a retractable door handle 10; a linkage 30 which is connected to door handle 10 to kinematically project (hereinafter, referred to as "pop out") the door handle 10 from outer door panel 20 in the width direction of the vehicle or retract (hereinafter, referred to as "pop in") door handle 10 into recess 22 of outer door panel 20; a driving device 40 that drives linkage 30; a base plate 50 on which door handle 10, linkage 30, and driving device 50 are mounted and supported; a cover 60 connected with linkage 30 and covering one surface of an insertion hole formed in door handle 10 to guide a passenger's hand when a passenger reaches into the insertion hole, a control lever 70 for manually controlling a projection height of a skin surface of door handle 10, and a door latch link 80 for unlocking a door latch.

In a further example embodiment, retractable door handle 10 also may include a handle body 12 that a passenger can grip and an insertion hole 14 formed in handle body 12 so that the passenger can grip handle body 12 by inserting their hand into insertion hole 14.

Base plate 50 includes an outer surface 52 facing the outside of the vehicle in the width direction of the vehicle, an upper surface 54 extending towards a vehicle interior from an upper edge of outer surface 52, and a lower surface 56 extending towards the vehicle interior from a lower edge of the outer surface 52, such that the upper surface, the outer surface and the lower surface together have substantially a C-shape ("⊔").

A first and second elongated guide hole 57 and 58, respectively, may be formed in both the upper surface 54 and the lower surface 56 of base plate 50. Each elongated guide hole may each formed along an axis that is parallel to a longitudinal axis of the vehicle. For instance, as shown in the Figures, the first and second elongated guide holes are formed along substantially the same axis, and that axis is parallel to a longitudinal axis of the vehicle. As also shown, the first elongated guide hole 57 in each of the upper surface 54 and the lower surface 56 may be formed toward a front end of the vehicle, and the second elongated guide hole 58 in each of the upper surface 54 and the lower surface 56 may be formed toward a rear end of the vehicle.

First elongated guide hole 57 may have a relatively shorter length than second elongated guide hole 58.

An inner cover plate 51 may be coupled to the side of base plate 50 facing the vehicle interior and a lower cover plate 53 may be coupled to the bottom of the base plate 50.

Two bosses 512 (e.g., studs or other protuberances) may be formed on inner cover plate 51, and respective pins may be inserted into the bosses 512. Linkage 30 may then be mounted on bosses 512 such that linkage 30 can pivot around the pins. Linkage 30 may include a first link pin 31 inserted into the first elongated guide hole 57 and may further include a second link pin 33 inserted into the second elongated guide hole 58.

Linkage 30 may also include two main links 32, including a first and second main link. The first main link may have one end joined to the door handle 10 and may have another end coupled to the first link pin 31. The second main link may have one end joined to the door handle 10 and may have another end coupled to the second link pin 33.

Further, the linkage 30 may include two auxiliary links 34, including a first and second auxiliary link. The first auxiliary link may have one end joined to a predetermined portion of the first main link in the longitudinal direction of the first main link and may have another end into which a first pin can be inserted. With that same first pin inserted into the boss 512 of the inner cover plate 51, the first auxiliary link can pivot around the first pin. Likewise, the second auxiliary link may have one end joined to a predetermined portion of the second main link in the longitudinal direction of the second main link and may have another end into which a second pin can be inserted. With that same second pin inserted into the other boss 512 of the inner cover plate 51, the second auxiliary link can pivot around the second pin.

Cover mechanism 60 may include an auxiliary cover 62 that guides a passenger's hand when the passenger inserts it into the insertion hole by covering one surface of insertion hole 14 formed in door handle 10. Two cover links 64 having one end joined to main link 32 with the pin and the other end joined to base plate 50 link auxiliary cover 62 with door handle 10.

The driving device 40 may include a driving motor 42 generating rotational force and a pair of cams 44 which transfer the rotational force of the driving motor to the first and second link pins 31 and 33 of main link 32 to allow the first and second link pins 31 and 33 to move along the first and second elongated guide holes 57 and 58. In a separate embodiment, pair of cams 44 may be replaced by a single cam.

The pair of cams 44 may have substantially an "S" shape and each cam 44 may include two cam grooves 442 having substantially a "U" shape and two cam push surfaces 444 having substantially an arc shape. Pair of cams 44 may be connected by a rotational shaft 46 so as to rotate together when rotational shaft 46 is rotated by the driving motor 42.

Figure 4:
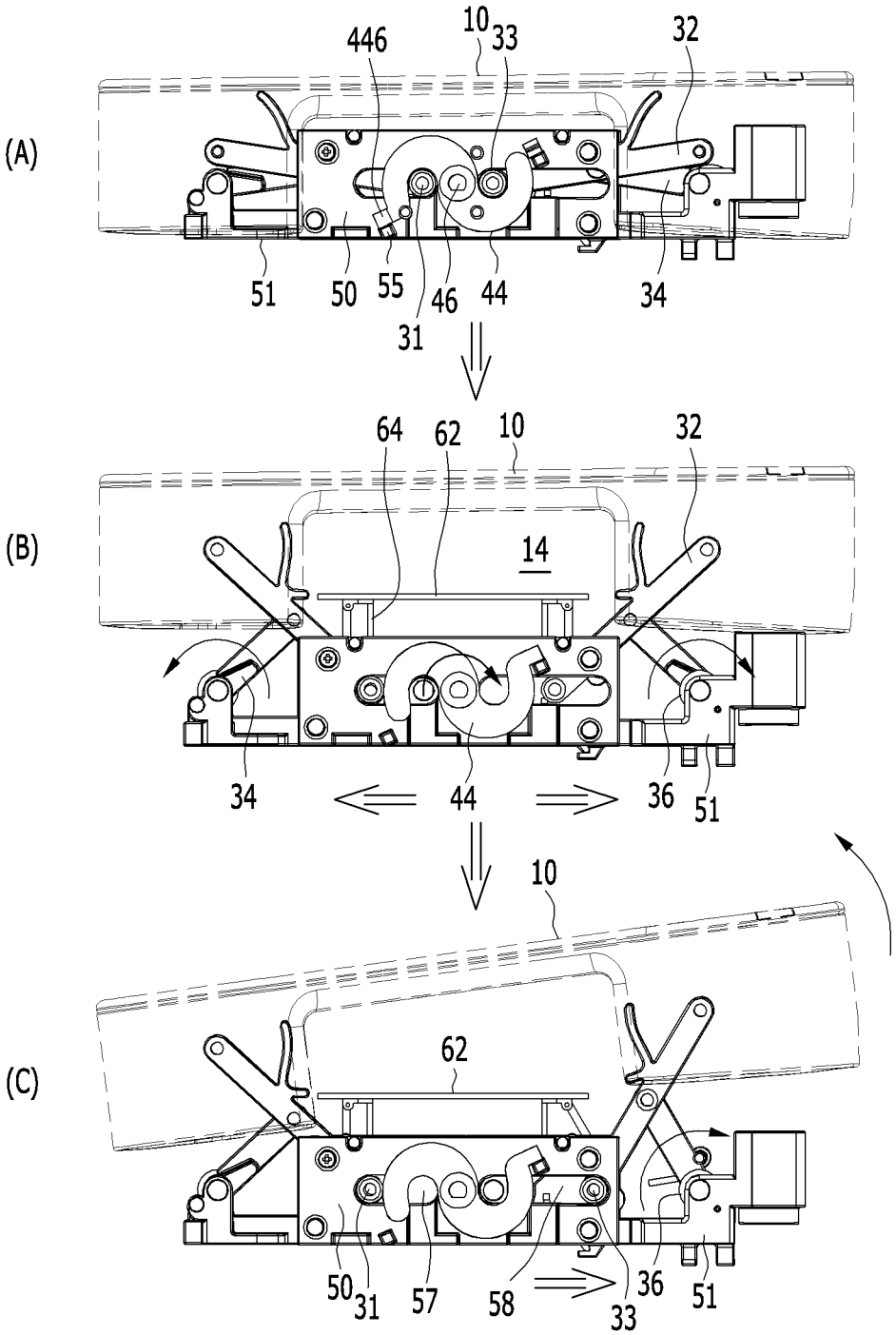
FIG. 4 is a diagram illustrating projection of a retractable door handle assembly according to an example embodiment.

Operation of an example embodiment of the retractable door handle assembly is described below with reference to FIG. 4.

FIG. 4A illustrates the state in which the door handle 10 is accommodated in recess 22 of outer door panel 20, i.e., a pop-in state in which the door handle 10 is not projected outward from outer door panel 20 in the width direction of the vehicle.

When a driver approaches the vehicle while holding, for example, a smart key, a control device causes power to be supplied to driving motor 42, thereby actuating driving motor 42 and causing cam 44 to rotate. When cam 44 rotates clockwise, first and second link pins 31 and 33 are pushed away from each other by cam push surface 444 of cam 44, and the first and second link pins 31 and 33 are guided and moved along the first and second elongated guide holes 57 and 58. As a result, the main link 32 is projected by pivoting towards a laterally-outward direction from the vehicle while being supported by auxiliary link 34, thereby projecting door handle 10 from outer door panel 20 (i.e. door handle 10 transitions to a pop-out state, as shown in FIG. 4B).

As used herein, "clockwise" refers to a clockwise direction from the vantage point of a passenger facing the outer door panel from the outside of the vehicle. Similarly, "counterclockwise" refers to a counterclockwise direction from the vantage point of a passenger facing the outer door panel from the outside of the vehicle.

A pair of front and rear main links 32 and auxiliary links 34, described in detail below, allow smooth and stable performance of pop-out and pop-in operation of door handle 10.

Cover link 64 also pops out auxiliary cover 62 towards the outside of the vehicle in the width direction of the vehicle by pivoting of main link 32 towards the outside in the width direction of the vehicle.

Because the cover link 64 is shorter than main link 32, the pop-out length of auxiliary cover 62 is less than the pop-out length of door handle 10, and as a result, an insertion hole 14 into which the passenger may insert a hand is created between the door handle 10 and the auxiliary cover 62 due to a difference in pop-out length.

When a passenger pulls door handle 10 towards the outside of the vehicle in the width direction of the vehicle by inserting a hand into insertion hole 14 of the door handle while the door handle 10 is in the pop-out state, a rear part of door handle 10 in the longitudinal direction of the vehicle is projected further outward in the width direction of the vehicle than a front part of door handle 10, as shown in FIG. 4C. In this case, first link pin 31 positioned towards a front end of the vehicle will no longer move as it has reached the end of the first elongated guide hole 57, while second link pin 33 positioned towards a rear end of the vehicle continues to move along the second elongated guide hole 58, thus allowing the rear of door handle 10 to move farther towards the outside of the vehicle than the front of door handle 10. As a result, as shown in FIG. 4C, only one portion of the door handle 10 pops out—namely, the portion of the door handle 10 that is towards a rear end of the vehicle Meanwhile, when the vehicle door is closed again, the front and rear auxiliary links 34 rotate clockwise and counterclockwise, respectively, due to the elastic restoration force of a torsion spring 36 wound on a pin shaft of auxiliary links 34. Auxiliary links 34 move two first and second link pins 31 and 33 towards each other and cam 44 inversely rotates counterclockwise.

Figure 5:
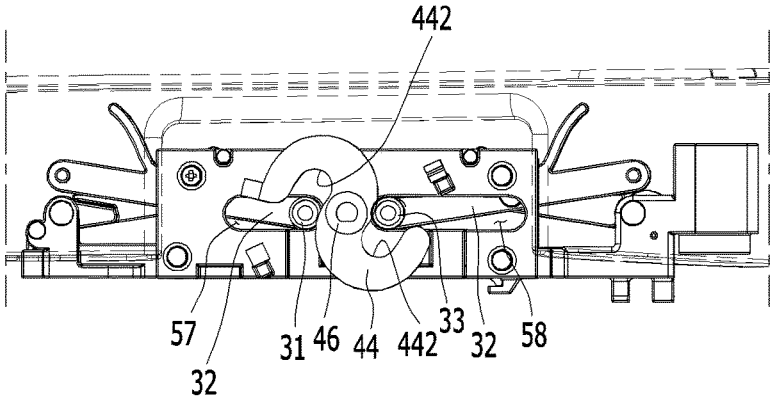
FIG. 5 is a diagram illustrating retraction of a retractable door handle assembly according to an example embodiment.

When first and second link pins 31 and 33 approach cam groove 442 during the simultaneous operating process, first and second link pins 31 and 33 forcibly move towards each other while being inserted into cam groove 442 due to rotation of cam 44, as illustrated in FIG. 5. As a result, door handle 10 transitions to the pop-in state and is completely retracted into recess 22 of outer door panel 20, as in FIG. 4A.

A stopper protrusion 55 is provided on base plate 50 to prevent excessive inverse movement of cam 44 during a counterclockwise inverse movement. A stopper projection 446 is formed at one end of cam 44. When stopper projection 446 contacts stopper protrusion 55 of base plate 50, cam 44 may no longer inversely rotate. (See FIG. 4A)

Figure 6:
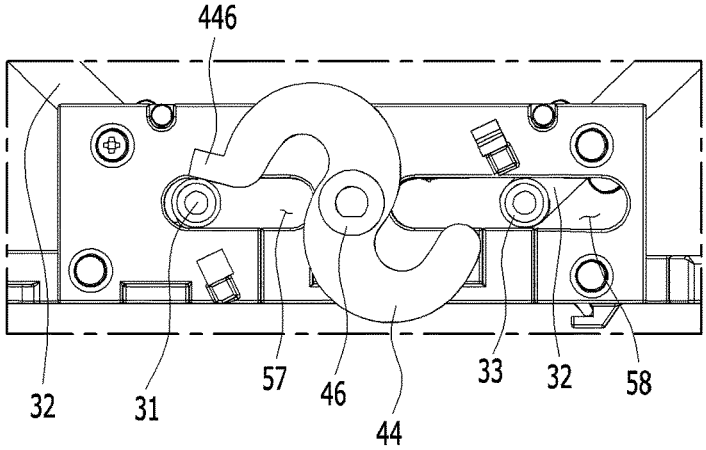
FIG. 6 is a diagram illustrating prevention of inverse rotation of a cam in the state where a door handle of the retractable door handle assembly according to an example embodiment projects laterally.

Further, as illustrated in FIG. 6, even though cam 44 rotates counterclockwise once the door handle 10 pops out, because stopper projection 446 prevents cam 44 from further rotating while contacting the first link pin 31 or the main link 32, undesired excessive inverse movement of cam 44 is prevented. As a result, the cam 44 may not move to a pop-in position to engage and fix the first and second links 31 and 33 into the cam groove 442.

Accordingly, if a passenger's hand is inserted into insertion hole 14 when the door handle 10 is popped out, because cam 44 prevents the door handle 10 from popping in, a safety accident may be prevented.

Figure 7:
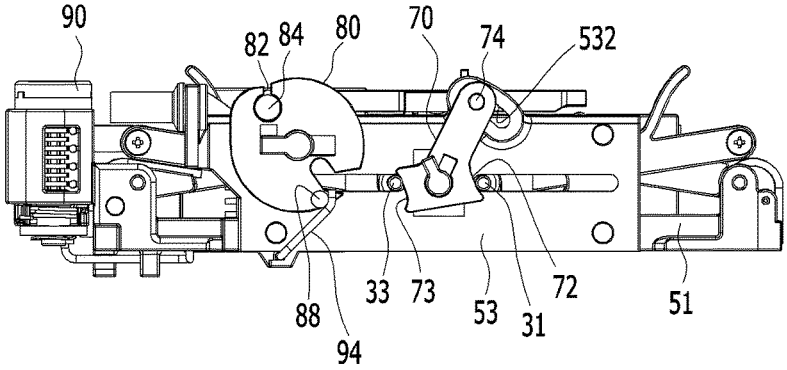
FIG. 7 is a bottom perspective view of a retractable door handle assembly according to an example embodiment.

Referring to FIG. 7, a conventional key cylinder 90 that is operated by inserting the key of the vehicle may be installed at one side of inner cover plate 51.

A substantially disk-shaped door latch link 80 may be rotatably installed on lower cover plate 53.

A connection groove 82 is formed at one side of door latch link 80 and one end of a door latch cable 84 connected with the door latch is inserted into the connection groove.

An operation groove 86 may be formed at the other side of door latch link 80 and a suspension protrusion 88 may protrude at a portion of door latch link 80 adjacent to operation groove 86.

Figure 8:
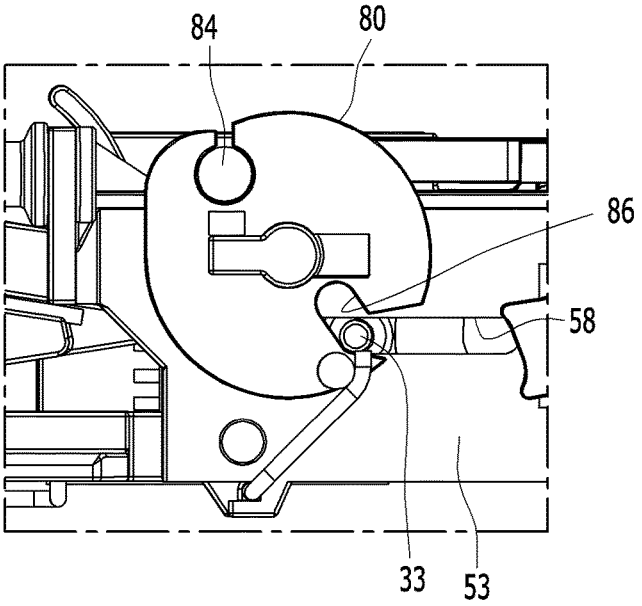
FIGS. 8 and 9 are diagrams illustrating the process of unlocking a door latch by operating a retractable door handle assembly according to an exemplary embodiment.
Figure 9:
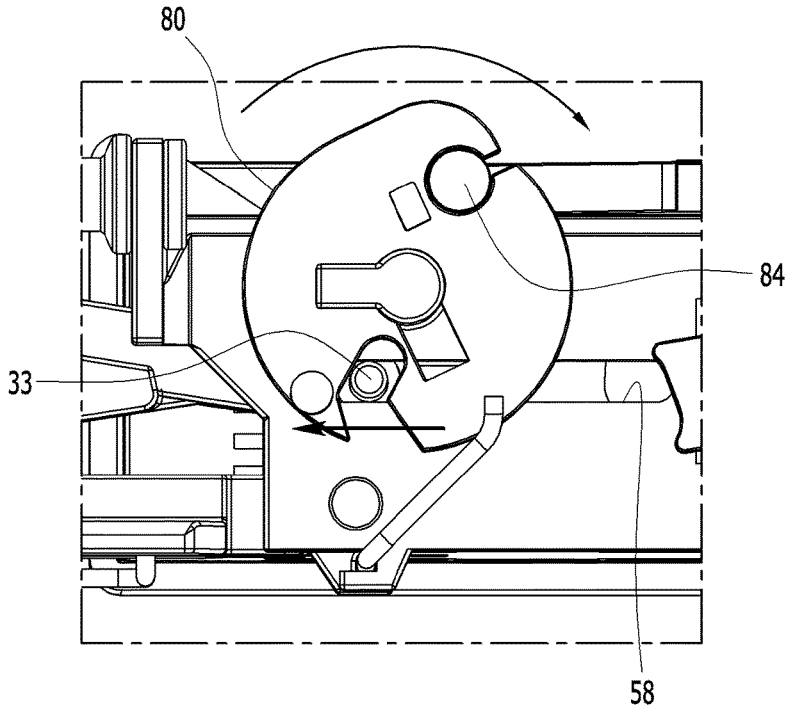

FIG. 7 illustrates a state in which door handle 10 pops in and the first and second link pins 31 and 33 are disposed to be close to each other and FIG. 8 illustrates a state in which door handle 10 is popped out by driving motor 42. When door handle 10 pops out, second link pin 33 inserted into the second elongated guide hole 58 is inserted into an inlet of operation groove 86. In this configuration, when a passenger pulls door handle 10, second link pin 33 further moves along second elongated guide hole 58, door latch link 80 rotates clockwise due to movement of second link pin 33, and door latch cable 84 is pulled. As a result, the door latch is switched to an unlocked state and the passenger may open the vehicle door.

Figure 10:
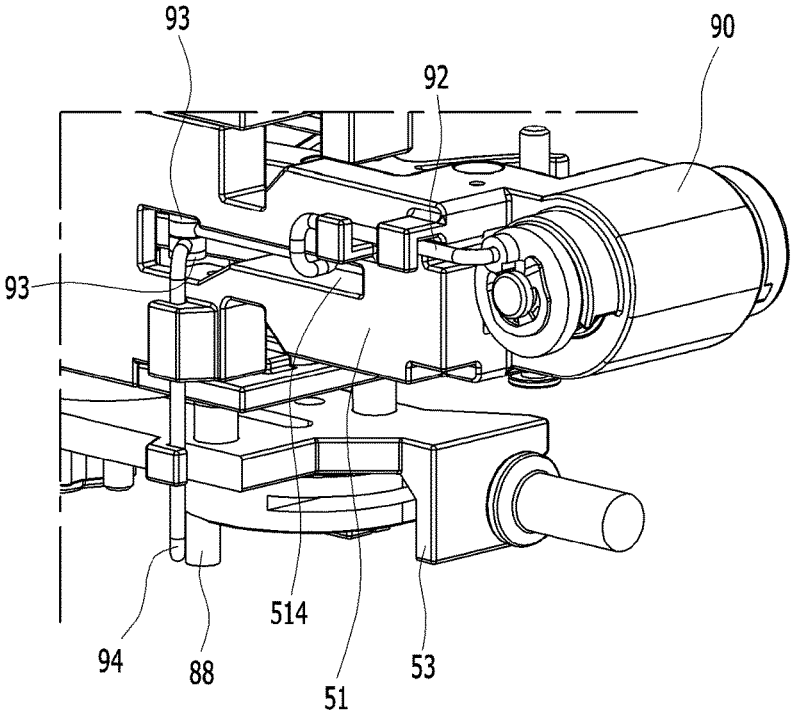
FIGS. 10 and 11 are diagrams illustrating a fail-safe function of a retractable door handle assembly according to an example embodiment.

Referring back to FIGS. 7 and 10, one end of a first door latch release rod 92 is connected to key cylinder 90 and the other end is connected to a pin 93; and one end of a second door latch release rod 94 is connected to pin 93 while the other end is suspended on a suspension protrusion 88. First door latch release rod 92 may move along a guide groove 514 formed on inner cover plate 51.

As a result, even when the driving motor is inoperable, the fail-safe function may be implemented so as to open the door.

Figure 11:
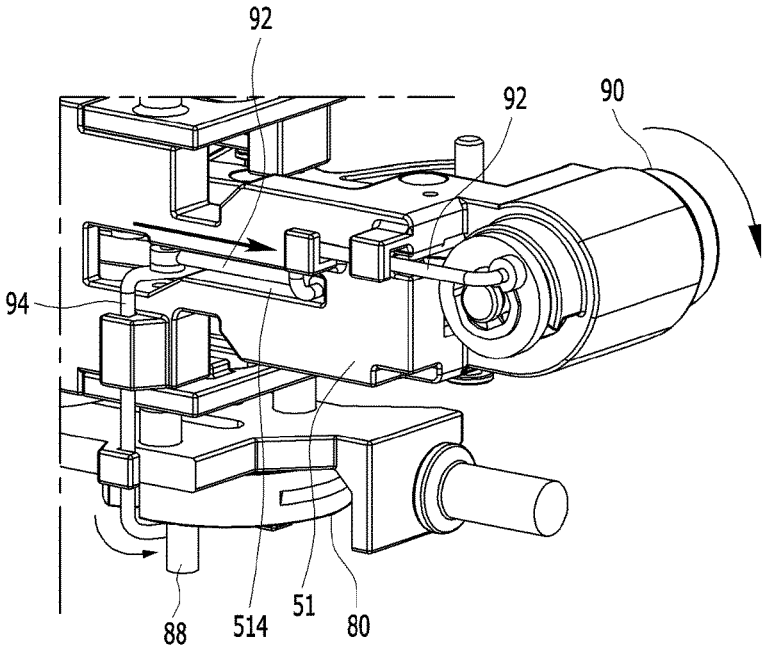

As illustrated in FIG. 11, when the driver inserts the vehicle key into key cylinder 90 and rotates it, first door latch release rod 92 moves along guide groove 514 and the second door latch release rod 94 rotates the door latch link 80 while rotating with the movement of the first door latch release rod 92. Door latch cable 84 is then pulled by rotating door latch link 80 and the door latch is unlocked to open the door.

Referring back to FIGS. 3 and 7, a guide hole 532 is formed at one edge of lower cover plate 53, control lever 70 is rotatably installed on lower cover plate 53, a fixing screw 74 is joined to one end of the control lever 70, and fixing screw 74 is inserted into guide hole 532 allowing fixing screw 74 to move along guide hole 532.

Furthermore, a pair of first and second cam surfaces 72 and 73 are formed at the other end of the control lever 70, and control lever 70 is installed on the lower cover plate 53 so that first cam surface 72 contacts first link pin 31, while second cam surface 73 contacts second link pin 73 when the door handle 10 pops in.

Control lever 70 may act to bring door handle 10 into outer door panel 20 such that the skin surface of door handle 10 and the skin surface of the outer door panel are co-planar, i.e. so that no step exists between the skin surfaces.

Figure 12:
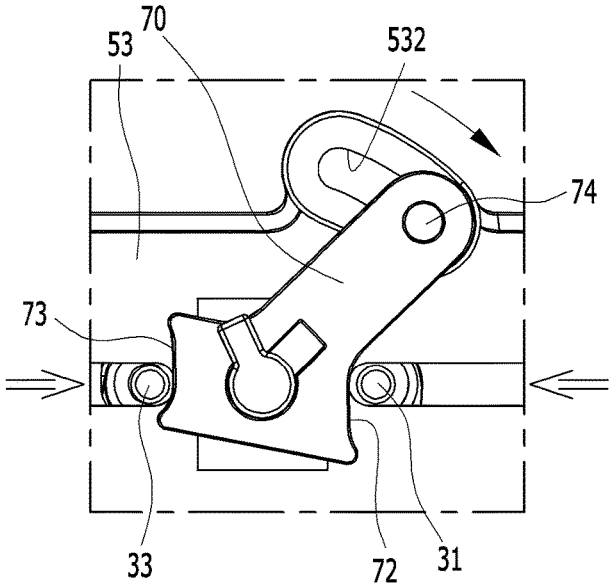
FIGS. 12, 13, 14, and 15 are diagrams illustrating a process of manually controlling whether the skin surface of a retractable door handle assembly according to an example embodiment is co-planar with the outer door panel.
Figure 13:
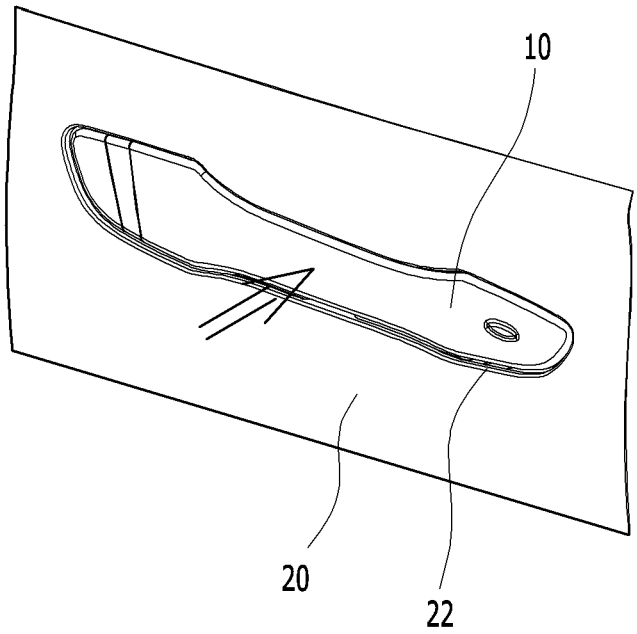

As illustrated in FIG. 12, when control lever 70 rotates, for example, clockwise, first and second links 31 and 33 contacting first and second surfaces 72 and 73 of the control lever 70, respectively, positioned on the bottoms of first and second cam surfaces 72 and 73 are brought to positions where they are closest to each other along the shapes of the first and second cam surfaces 72 and 73. As a result, as illustrated in FIG. 13, door handle 10 moves towards the vehicle interior (as shown by the arrow) through action of main link 32 and movement of the first and second links 31 and 33. In fact, the skin surface of door handle 10 can move further into the vehicle interior than the skin surface of the outer door panel 20.

Accordingly, when door handle 10 is projected outward from the outer door panel after the retractable door handle assembly is assembled to the outer door panel, door handle 10 may move into the vehicle interior by rotating the control lever 70 clockwise, and as a result, the skin surface of door handle 10 may be easily controlled so as to be co-planar with the skin surface of outer door panel 20. This provides a more pleasant aesthetic appearance for vehicle and assists in diminishing vehicle noise.

After door handle 10 has been retracted into a position where the skin surface of door handle 10 is co-planar with the skin surface of outer door panel 20, control lever 70 may be prevented from moving by tightening fixing screw 74.

Figure 14:
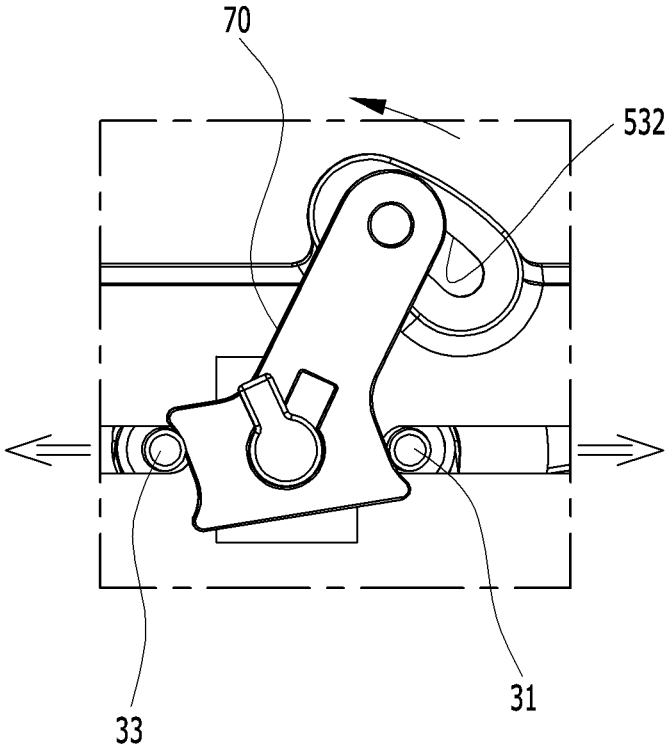
Figure 15:
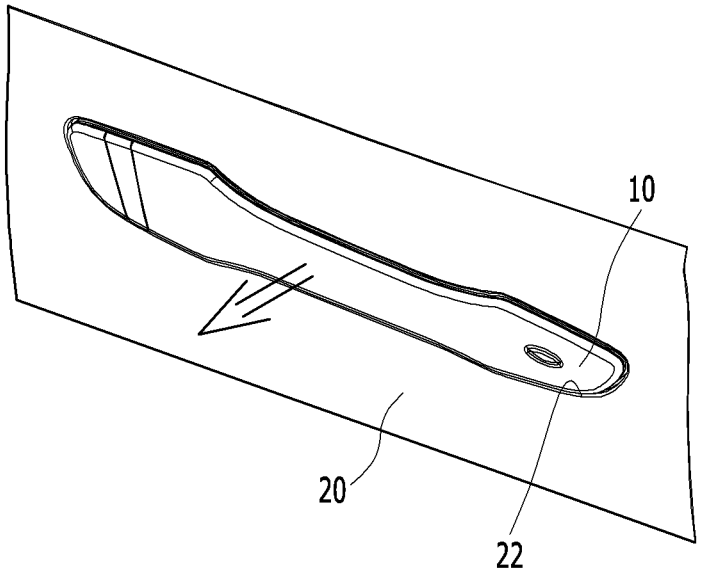

When door handle 10 moves further towards the vehicle interior than the outer door panel 20 after the retractable door handle assembly is assembled to outer door panel 20, door handle 10 can be moved back towards the outside of the vehicle by rotating the control lever 70 counterclockwise as illustrated in FIGS. 14 and 15, in order to make the skin surface of door handle 10 co-planar with the skin surface of outer door panel 20.

While this invention has been described in connection with practical example embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

10: Retractable door handle
20: Door outer panel
22: Accommodation hole
30: Linkage
40: Driving device
50: Base plate
60: Cover mechanism
70: Control lever
80: Door latch link

What is claimed is:

1. A retractable door handle assembly for a vehicle, comprising:

a retractable door handle installed in a door of the vehicle, the retractable door handle being configured to project laterally outward from or retract into an outer panel of the door; and a linkage connected to the door handle to support the door handle and allow the door handle to project laterally outward from or retract into the outer panel, wherein the linkage comprises at least one main link having at least one end connected to the door handle, and at least one auxiliary link having at least one end connected to the at least one main link to allow the at least one main link to pivot, wherein the at least one main link comprises a first main link and a second main link, the at least one end of the at least one main link comprises one end of the first main link connected to the door handle and one end of the second main link connected to the door handle;

the at least one auxiliary link comprises a first auxiliary link and a second auxiliary link, the at least one end of the at least one auxiliary link comprises one end of the first auxiliary link connected to the first main link to allow the first main link to pivot and one end of the second auxiliary link connected to the second main link to allow the second main link to pivot;

the first main link and the first auxiliary link together form a first pair disposed toward a front end of the vehicle, and the second main link and the second auxiliary link form a second pair disposed toward a rear end of the vehicle;

wherein the retractable door handle assembly further comprises:

a base plate having a first pair of elongated guide holes disposed towards the front end of the vehicle and a second pair of elongated guide holes disposed towards the rear end of the vehicle, wherein each of the first pair of elongated guide holes are shorter than each of the second pair of elongated guide holes;

a first link pin joined to the first main link and inserted into the first pair of elongated guide holes; and a second link pin joined to the second main link and inserted into the second pair of elongated guide holes.

2. The retractable door handle assembly of claim 1, wherein the base plate further comprises:

an outer surface facing laterally outward from the vehicle, an upper surface extending towards an interior of the vehicle from an upper edge of the outer surface, and a lower surface extending towards the interior of the vehicle from a lower edge of the outer surface, and wherein the first and second pairs of elongated guide holes are formed in both the upper surface and the lower surface of the base plate.

3. The retractable door handle assembly of claim 1, wherein the door handle comprises:

a graspable handle body, and an insertion hole formed in the handle body.

4. The retractable door handle assembly of claim 3, further comprising:

a cover mechanism connected with the linkage, wherein the cover mechanism moves with the door handle when a passenger inserts a hand into the insertion hole by covering a portion of the insertion hole.

5. The retractable door handle assembly of claim 4, wherein the cover mechanism comprises:

an auxiliary cover that guides the passenger's hand when it is inserted into the insertion hole by covering the portion of the insertion hole, and a first cover link and a second cover link each having one end joined to the first main link and the second main link with the first pin and the second pin, respectively, and another end joined to the base plate to link the auxiliary cover with the door handle.

6. The retractable door handle assembly of claim 3, further comprising:

a door latch cable connected with a door latch;

a door latch link rotatably installed and connected with the door latch cable; and an operation groove disposed in the door latch link, wherein the second link pin is selectively inserted into the operation groove to cause the door latch link to rotate, thereby pulling the door latch cable and unlocking the door latch.

7. The retractable door handle assembly of claim 6, further comprising:

a key cylinder;

a first door latch release rod having one end connected with the key cylinder and another end connected to a pin; and a second door latch release rod having one end connected to the pin and another end connected with the door latch link.

8. The retractable door handle assembly of claim 7, further comprising a guide groove formed on an inner cover plate that guides and moves the first door latch release rod.

9. The retractable door handle assembly of claim 1, wherein:

an inner cover plate is joined to the base plate and faces an interior of the vehicle, a first boss and a second boss are formed on the inner cover plate, and a first pin and a second pin are inserted into the first boss and the second boss and through the first auxiliary link and the second auxiliary link, respectively, such that the first auxiliary link and the second auxiliary link are pivotable around the first pin and the second pin, respectively.

10. The retractable door handle assembly of claim 9, further comprising:

at least one torsion spring that elastically supports at least one of the first and second auxiliary links.

11. The retractable door handle assembly of claim 1, further comprising:

a driving device providing operation force to the linkage, wherein the driving device includes:

a motor generating rotational force, and a first cam causing the first and second links to move along the first and second pairs of elongated guide holes by transferring the rotational force of the motor to the first and second link pins of the first main link and the second main link.

12. The retractable door handle assembly of claim 11, wherein the driving device further comprises:

a second cam forming a pair of cams with the first cam; and a rotational shaft that rotates the pair of cams, wherein the rotational shaft is connected to the motor and receives the rotational force from the motor.

13. The retractable door handle assembly of claim 12, wherein each of the first and second cams in the pair of cams is substantially "S" shaped and comprises two cam grooves that are substantially "U" shaped to engage and move the first and second link pins, respectively, and two cam push surfaces having an arc shape to push and move the first and second link pins.

14. The retractable door handle assembly of claim 11, further comprising:

a stopper protrusion formed on the base plate, and a stopper projection formed at one end of the first cam that blocks rotational movement of the first cam by contacting the stopper protrusion.

15. The retractable door handle assembly of claim 1, further comprising a rotatable control lever capable of moving the first and second link pins.

16. The retractable door handle assembly of claim 15, further comprising:

a lower cover plate joined to a lower side of the base plate;

a guide hole formed at one edge of the lower cover plate;

a control lever rotatably installed on the lower cover plate; and a fixing screw joined to one end of the control lever, and wherein the fixing screw is inserted into the guide hole and is capable of moving along the guide hole.

17. The retractable door handle assembly of claim 16, wherein the control lever comprises first and second cam surfaces contacting the first and second link pins.

* * * * *